US007626133B2

(12) United States Patent
Wu et al.

(10) Patent No.: US 7,626,133 B2
(45) **Date of Patent: *Dec. 1, 2009**

(54) METALLIC PANEL ASSEMBLY HAVING RIPPLE LUSTER

(75) Inventors: Che-Tung Wu, Taoyuan (TW); Chih-Ho Hsu, Taoyuan (TW); Kai-Jie Tsao, Taoyuan (TW)

(73) Assignee: Ichia Technologies, Inc., Taoyuan (TW)

( * ) Notice: Subject to any disclaimer, the term of this patent is extended or adjusted under 35 U.S.C. 154(b) by 92 days.

This patent is subject to a terminal disclaimer.

(21) Appl. No.: 11/946,553

(22) Filed: Nov. 28, 2007

(65) Prior Publication Data

US 2009/0114516 A1 May 7, 2009

(30) Foreign Application Priority Data

Nov. 7, 2007 (TW) ..... 96218758 U

(51) Int. Cl.
*H01H 13/14* (2006.01)

(52) U.S. Cl. ..... 200/341; 200/5 A

(58) Field of Classification Search ..... 200/5 A, 200/302.2, 310–317, 341
See application file for complete search history.

(56) References Cited

U.S. PATENT DOCUMENTS 6,573,463 B2 * 6/2003 Ono ..... 200/5 A
7,070,349 B2 * 7/2006 Dombrowski et al. ..... 400/490

FOREIGN PATENT DOCUMENTS

JP 2007-134071 5/2007

* cited by examiner

*Primary Examiner*—Kyung Lee
(74) *Attorney, Agent, or Firm*—Chun-Ming Shih

(57) ABSTRACT

A metallic panel assembly having a ripple luster includes an elastic layer, an adhesive layer, a metallic keypad panel, an electroplated layer and an ultraviolet curable resin layer. The elastic layer has a carrier. The carrier is provided thereon with a plurality of protrusions. The adhesive layer is provided on one side surface of the carrier. The metallic keypad panel is provided on one side surface of the adhesive layer and has a thin plate thereon. The plate is provided thereon with a first hollowed portion and a second hollowed portion. The first hollowed portion is set as a pressing region of a key, and the second hollowed portion is set as an icon on the surface of the pressing region. The electroplated layer is provided on one side surface of the metallic keypad panel and penetrates into the first hollowed portion and the second hollowed portion. The ultraviolet curable resin layer is provided on one side surface of the electroplated layer to seal and fill the first hollowed portion and the second hollowed portion. The ultraviolet curable resin layer has a carrier thereon, and one side surface of the carrier is provided with a pattern surface. When external light illuminates the pattern surface of the metallic keypad panel, the pattern surface generates a reflective effect of a ripple luster.

11 Claims, 7 Drawing Sheets

METALLIC PANEL ASSEMBLY HAVING RIPPLE LUSTER

BACKGROUND OF THE INVENTION

1. Field of the Invention

The present invention relates to a keypad panel, and in particular to a metallic panel assembly.

2. Description of Prior Art

Keypad panel has become a necessary hardware for an electronic device. The surface of the keypad on the keypad panel is provided with numerals, characters, phonetic symbols, roots for an input method and various functional icons, so that a user can input data or perform various functions of the electronic device. Therefore, for a handheld electronic device, the keypad panel is a very important input means.

For example, a conventional metallic keypad panel on an electronic device is shown in FIGS. 1(*a*) to 1(*f*) (Japanese Laid-Open Patent Publication No. 2007-134071). In manufacturing the metallic keypad panel 10*a* disclosed in FIG. 1, a metallic plate 1*a* is prepared first, and the metallic plate 1*a* is attached on a transparent plastic film 2*a*. Then, the metallic plate 1*a* is made to have a hollowed portion 3*a*. The surface of the metallic plate 1*a* is formed with a transparent resin layer 4*a*. The bottom of the transparent plastic film 2*a* is formed with a transparent elastic layer 5*a*. In manufacturing the transparent elastic layer 5*a*, via a hot pressing process, the transparent plastic film 2*a* and the transparent elastic layer 5*a* are compressed into the hollowed portion 3*a* together, thereby forming a separating line 21*a* for separating the metallic keys. Then, a light-emitting layer 6*a* is attached to the bottom of the transparent elastic layer 5*a*.

In manufacturing the above metallic keypad panel 10*a*, since the transparent plastic film 2*a* and the transparent elastic layer 5*a* are compressed into the hollowed portion 3*a* together, the pressing force and the heating temperature should be properly controlled during the hot pressing process. Otherwise, the transparent plastic film 2*a* and the transparent elastic layer 5*a* cannot be compressed into the hollowed portion 3*a* completely, causing defective products. Even, during the process of compressing the transparent plastic film 2*a* and the transparent elastic layer 5*a* into the hollowed portion 3*a*, the transparent plastic film 2*a* may rub and pull the wall faces and chamfers of the hollowed portion 3*a*, causing the breakage of the transparent plastic film 2*a* easily and the difficulty in manufacture.

Next, gaps are generated easily between the transparent plastic film 2*a* compressed into the hollowed portion 3*a* and the wall face of the hollowed portion 3*a*. The gaps may be filled by dusts or penetrated by liquid, so that the metallic keys cannot be pressed smoothly or an internal short circuit may occur.

Further, the surface of the transparent resin layer 4*a* formed on the metallic plate 1*a* is a flat surface, which merely provides a protective effect for the metallic plate 1*a* without any reflective effect of a particular luster. Therefore, the external appearance and the overall visual effect of the metallic keypad panel 10*a* are dull.

SUMMARY OF THE INVENTION

In view of the above drawbacks, the present invention is to provide a novel and simple method for manufacturing a metallic keypad panel that allows a metallic keypad panel to be manufactured easily and also makes the surface of the metallic keypad panel to have a reflective effect of a ripple luster.

The present invention is to provide a metallic panel assembly having a ripple luster, which includes an elastic layer, an adhesive layer, a metallic keypad panel, an electroplated layer and an ultraviolet curable resin layer. The elastic layer has a carrier. One side surface of the carrier is provided with a plurality of protrusions. The adhesive layer is provided on one side surface of the carrier for binding the metallic keypad panel. The metallic keypad panel is provided on one side surface of the adhesive layer and has a thin plate thereon. The plate is provided thereon with a first hollowed portion and a second hollowed portion. The first hollowed portion encircles a pressing region of a keypad via lines, and the second hollowed portion is set as an icon on the surface of the pressing region. The electroplated layer is provided on one side surface of the metallic keypad panel and penetrates into the first hollowed portion and the second hollowed portion. The ultraviolet curable resin layer is provided on one side surface of the electroplated layer to seal and fill the first hollowed portion and the second hollowed portion. The ultraviolet curable resin layer has a carrier thereon. One side surface of the carrier is provided with a pattern surface.

DETAILED DESCRIPTION OF THE INVENTION

The detailed description and the technical contents of the present invention will be explained with reference to the accompanying drawings.

Figure 1:
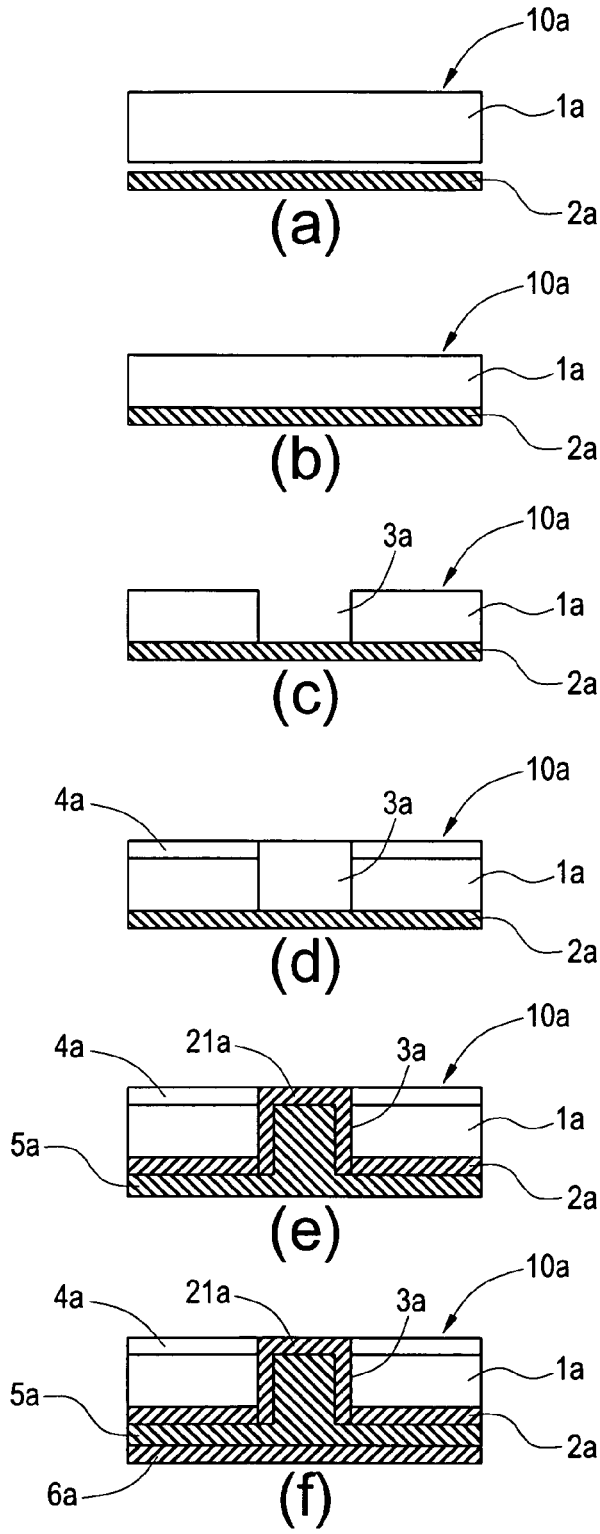
FIG.1 PRIOR ART
FIGS. 1(*a*) to 1(*f*) are structural views showing a procedure for manufacturing a traditional metallic keypad panel.
Figure 2:
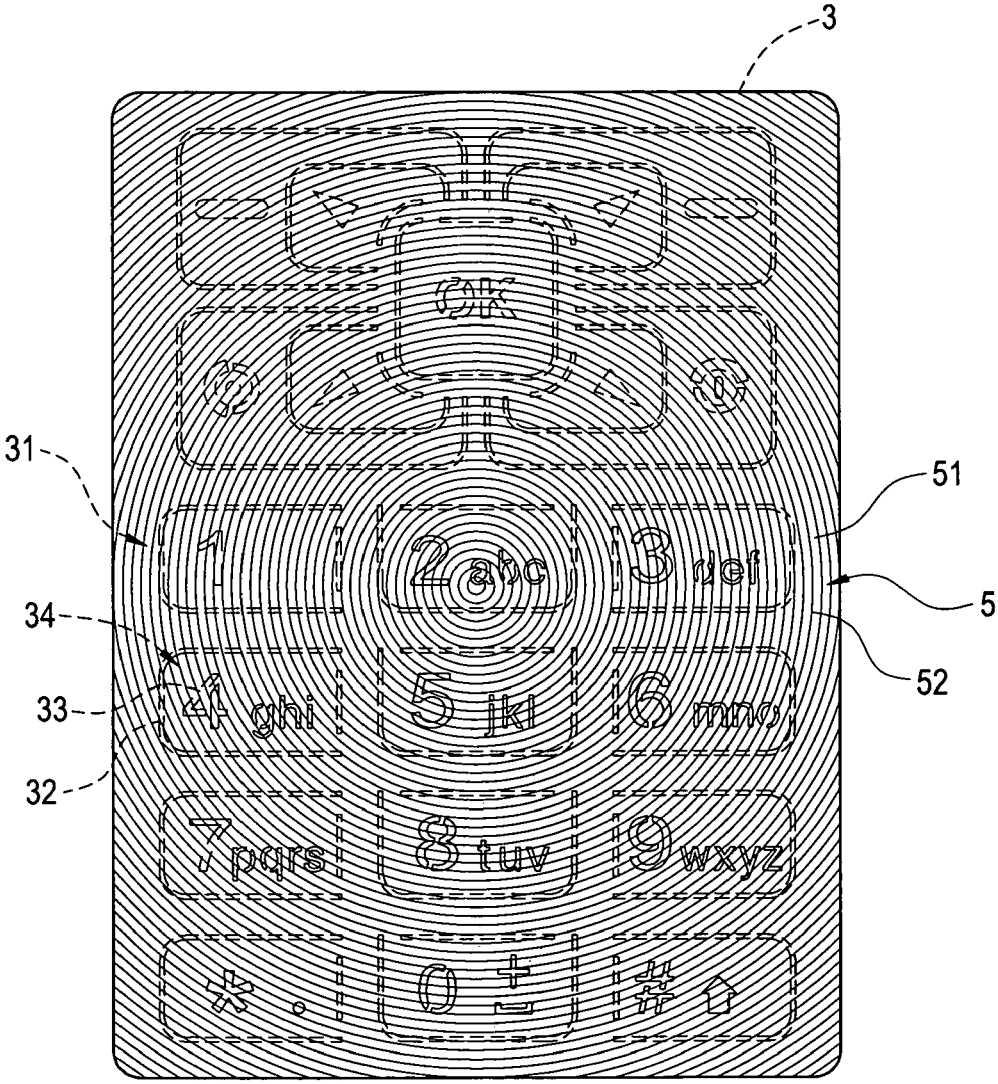
FIG. 2 is a schematic view showing the external appearance of the metallic keypad panel of the present invention.
Figure 3:
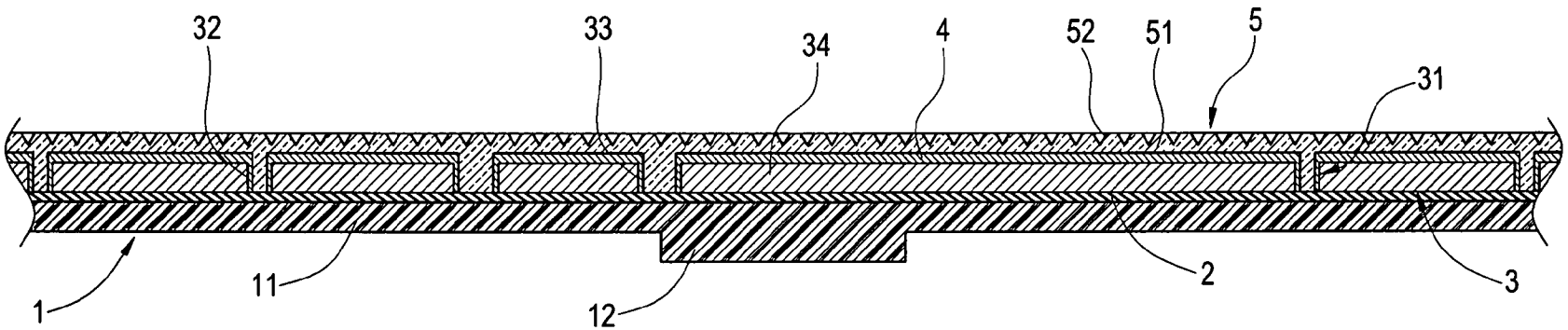
FIG. 3 is a side cross-sectional view showing the metallic keypad panel of the present invention.

FIG. 2 is a schematic view showing the external appearance of the metallic keypad panel of the present invention, and FIG. 3 is a side cross-sectional view showing the metallic keypad panel of the present invention. As shown in these figures, the present invention provides a metallic panel assembly having a ripple luster, which includes an elastic layer 1, an adhesive layer 2, a metallic keypad panel 3, an electroplated layer 4 and an ultraviolet curable resin layer 5.

The elastic layer 1 is made of a transparent rubber material and has a carrier 11 thereon. One side surface of the carrier 11 is provided thereon with a plurality of protrusions 12.

The adhesive layer 2 is provided on one side surface of the carrier 11 for binding the metallic keypad panel 3.

The metallic keypad panel 3 is provided on one side surface of the adhesive layer 2 and is made of stainless steel (SUS) or Al—Mg alloy to form a thin plate 31. The plate 31 is provided thereon with a first hollowed portion 32 and a second hollowed portion 33. The first hollowed portion 32 encircles a pressing region 34 of a keypad via lines, and the second hollowed portion 33 is set as an icon on the surface of the pressing region 34. The icon includes any one of numerals (0 to 9), characters (A to Z), special symbols (e.g., "#", "*", "." etc.), dialing icon, ending icon and navigational symbols.

The electroplated layer 4 is provided on one side surface of the metallic keypad panel 3 and penetrates into the first hollowed portion 32 and the second hollowed portion 33. The electroplated layer is made of a metallic material such as nickel.

The ultraviolet curable resin layer 5 is provided on one side surface of the electroplated layer 4 and has a carrier 51 thereon. The surface of the carrier 51 is provided with a pattern surface 52. The pattern surface 52 is a spinning having a ripple luster. Further, the ultraviolet curable resin layer 5 also forms a protective layer for the metallic keypad panel 3.

Figure 4:
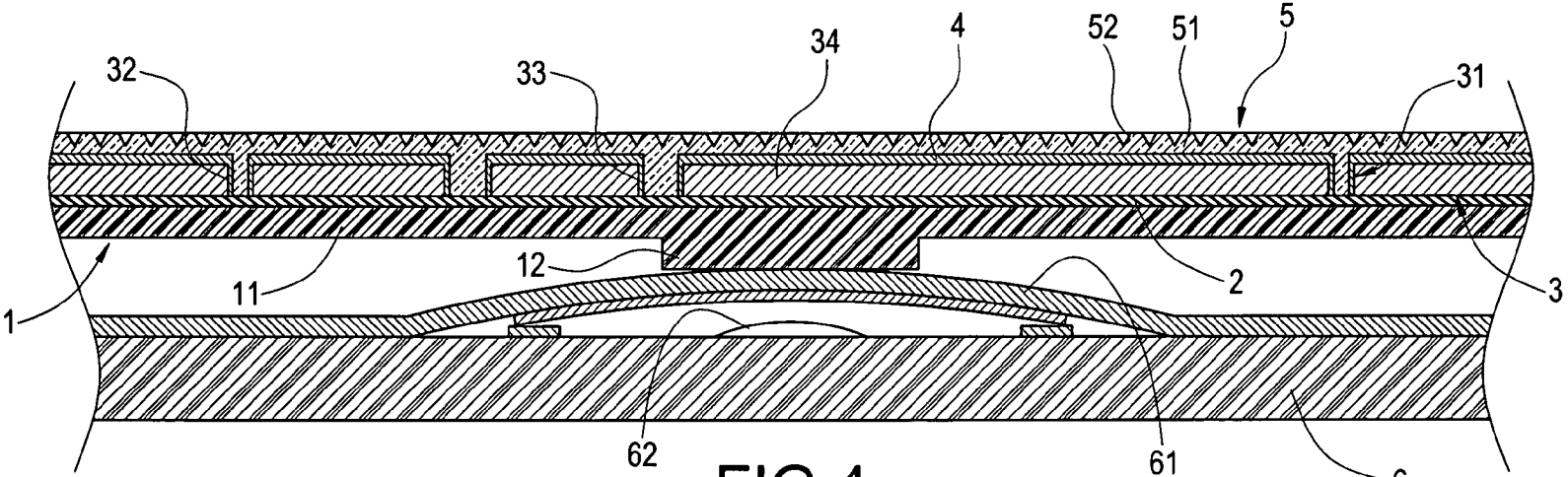
FIG. 4 is a schematic view showing the metallic keypad panel of the present invention being used in a circuit board of an electronic device.
Figure 5:
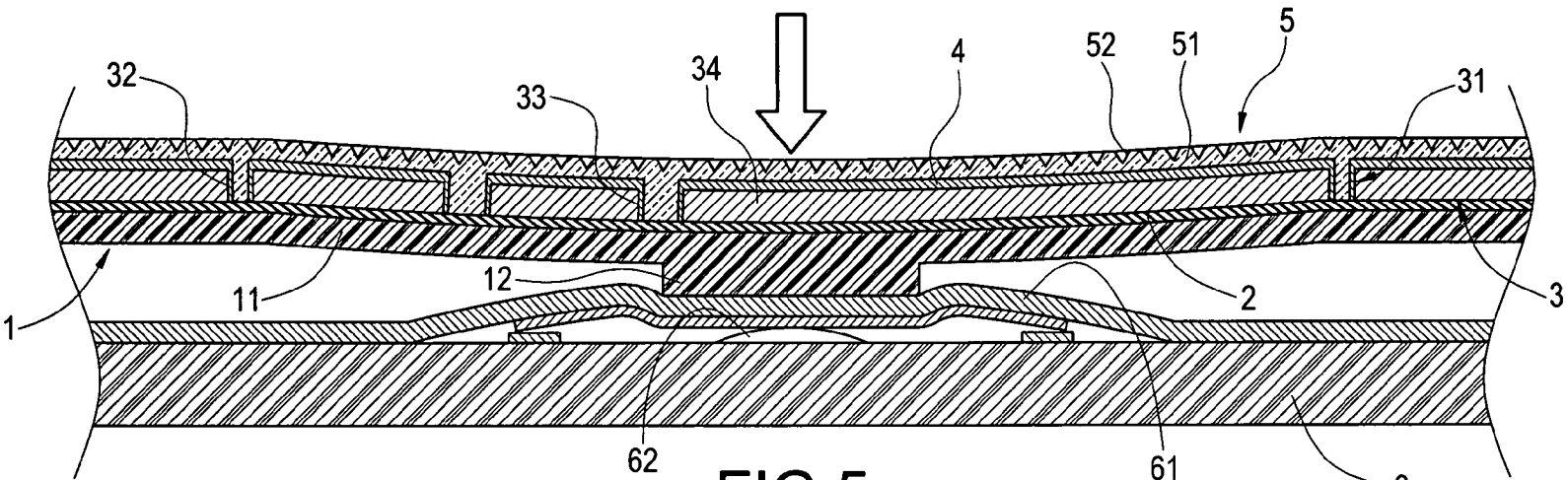
FIG. 5 is a schematic view showing an operating state in FIG. 4.

FIG. 4 is a schematic view showing the metallic keypad panel of the present invention being used in a circuit board of an electronic device, and FIG. 5 is a schematic view showing an operating state in FIG. 4. As shown in these figures, when the pressing region 34 of the metallic keypad panel 3 is pressed by an external force, the pressing of the pressing region 34 causes the deformation of the carrier 11 of the elastic layer 1, so that the protrusion 12 is pressed against an elastic piece 61 of a circuit board 6. In this way, the elastic piece 61 is deformed to contact a conductive point 62 of the circuit board 6, thereby generating a conductive signal output.

When the surface of the pressing region 34 is not pressed by an external force, the elasticity of the materials of the metallic keypad panel 3 and the elastic layer 1 allows the pressing region 34 to rise automatically, thereby returning to its original state.

Figure 6:
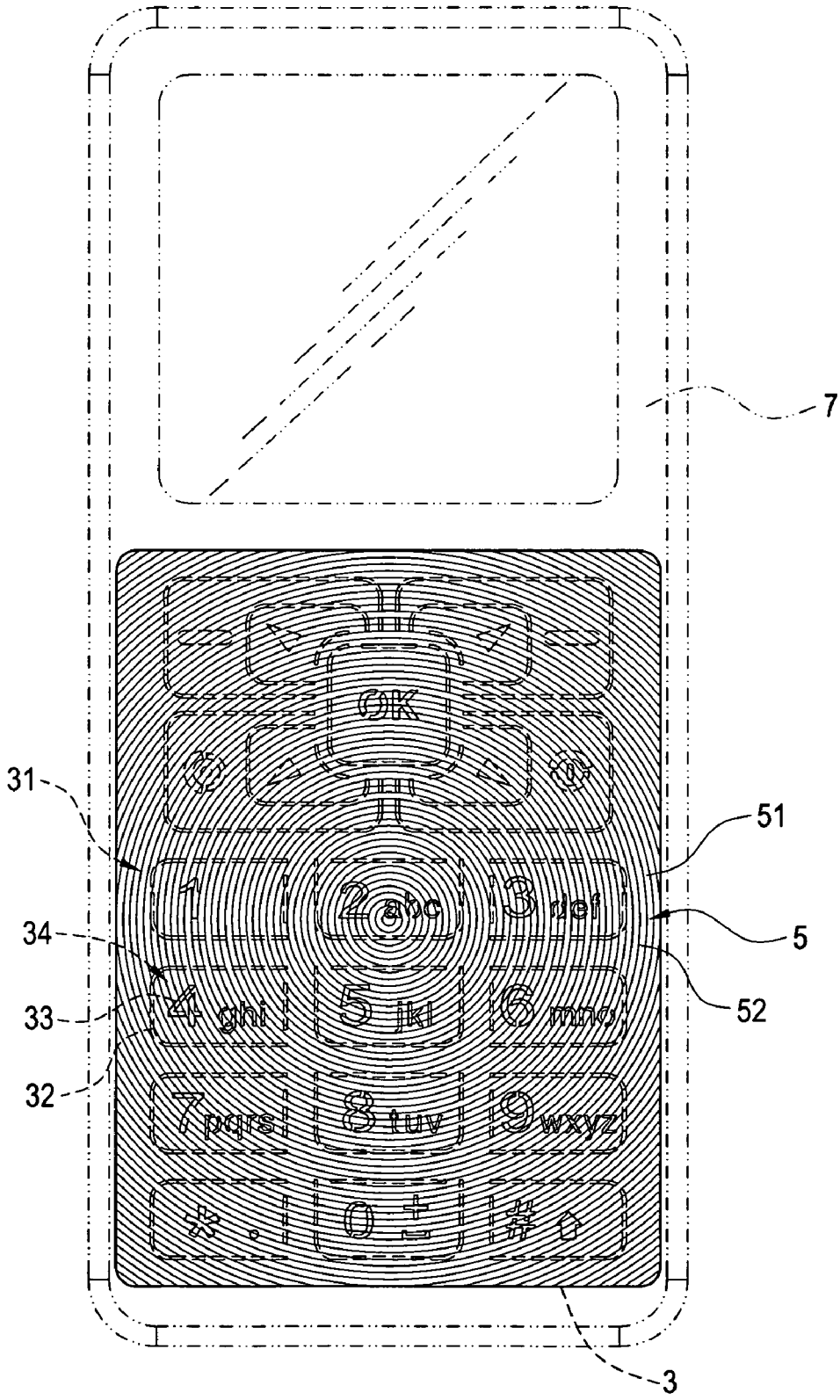
FIG. 6 is a schematic view showing the metallic keypad panel of the present invention being used in a mobile phone.

With reference to FIG. 6, it is a schematic view showing the metallic keypad panel of the present invention being used in a mobile phone. As shown in this figure, after the metallic keypad panel 3 of the present invention is manufactured completely, it can be applied to a mobile phone 7. When the light illuminates the ultraviolet curable resin layer 5 of the metallic keypad panel 3, the pattern surface 52 on the ultraviolet curable resin layer 5 generates a reflective effect of a ripple luster, thereby increasing the aesthetic feeling of the mobile phone 7. Further, the ultraviolet curable resin layer 5 can protect the surface of the metallic keypad panel 3 from suffering damage due to external rigid objects.

Figure 7:
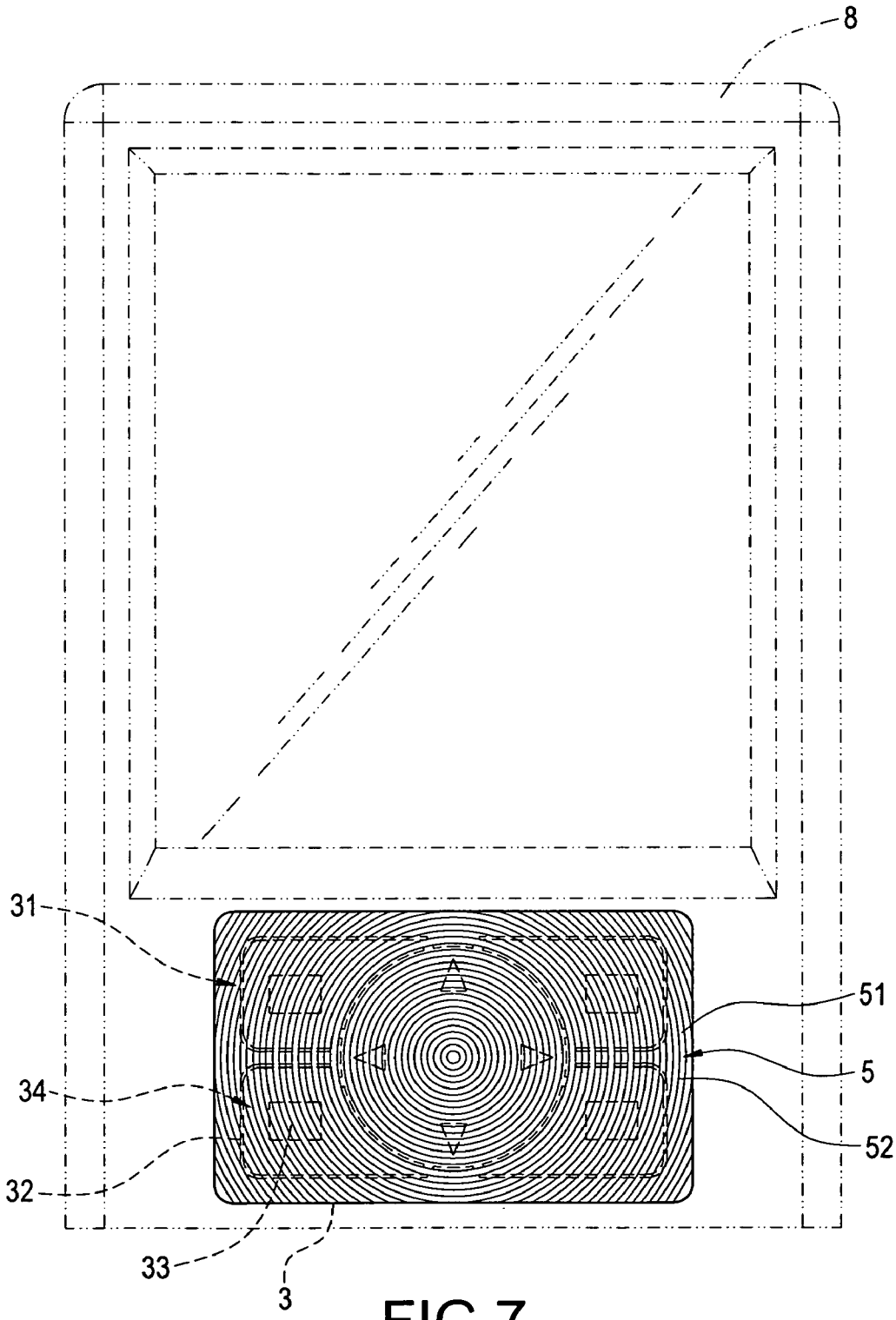
FIG. 7 is a schematic view showing the metallic keypad panel of the present invention being used in a personal digital assistant (PDA)

With reference to FIG. 7, it is a schematic view showing the metallic keypad panel of the present invention being used in a personal digital assistant (PDA). As shown in this figure, after the metallic keypad panel 3 of the present invention is manufactured completely, in addition to the mobile phone 7, it can be applied to a personal digital assistant (PDA) 8. When the light illuminates the ultraviolet curable resin layer 5 of the metallic keypad panel 3, the pattern surface 52 on the ultraviolet curable resin layer 5 generates a reflective effect of a ripple luster, thereby increasing the aesthetic feeling of the personal digital assistant (PDA) 8.

Figure 8:
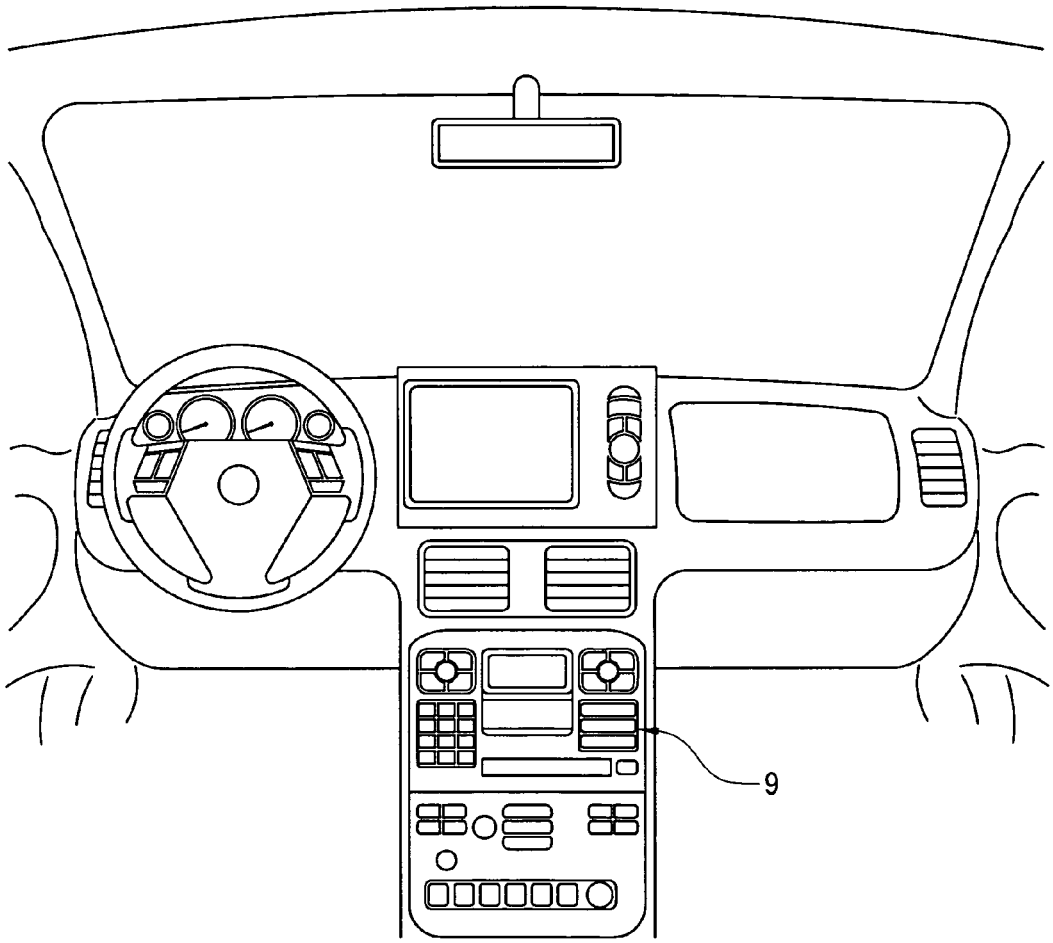
FIG. 8 is a schematic view showing the metallic keypad panel of the present invention being used in an automobile stereo panel.

With reference to FIG. 8, it is a schematic view showing the metallic keypad panel of the present invention being used in an automobile stereo panel. As shown in this figure, in addition to the mobile phone 7 and the personal digital assistant (PDA) 8, the metallic keypad panel assembly of the present invention can be mounted on an automobile stereo panel 9, thereby controlling the operations of an air conditioning system, audio-video system and satellite navigation system.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A metallic panel assembly having a ripple luster, arranged on an electronic device and comprising:

an elastic layer having a carrier thereon, one side surface of the carrier being provided with a plurality of protrusions;

a metallic keypad panel provided on one side surface of the carrier and having a thin plate thereon, the plate being provided thereon with a first hollowed portion and a second hollowed portion, the first hollowed portion being set as a pressing region, the second hollowed portion being set as an icon on the surface of the pressing region;

an ultraviolet curable resin layer provided on one side surface of the metallic keypad panel to seal and fill the first hollowed portion and the second hollowed portion, the ultraviolet curable resin layer having a carrier thereon, and one side surface of the carrier having a pattern surface; and an electroplated layer provided between the metallic keypad panel and the ultraviolet curable resin layer.

2. The metallic panel assembly having a ripple luster according to claim 1, wherein the elastic layer is made of a transparent rubber material.

3. The metallic panel assembly having a ripple luster according to claim 1, wherein the metallic keypad panel is made of stainless steel (SUS) or Al—Mg alloy.

4. The metallic panel assembly having a ripple luster according to claim 1, wherein the first hollowed portion has a linear shape and encircles a pressing region via lines.

5. The metallic panel assembly having a ripple luster according to claim 1, wherein the icon comprise any one of numerals, characters, special symbols, dialing icon, ending icon and navigational symbols.

6. The metallic panel assembly having a ripple luster according to claim 5, wherein the special symbol comprises "#', "*", "." etc.

7. The metallic panel assembly having a ripple luster according to claim 1, further comprising an adhesive layer provided between the elastic layer and the metallic keypad panel, the adhesive layer allowing the elastic layer to be bound with the metallic keypad panel.

8. The metallic panel assembly having a ripple luster according to claim 1, wherein the pattern of the pattern surface is a spinning.

9. The metallic panel assembly having a ripple luster according to claim 1, wherein the ultraviolet curable resin layer forms a protective layer for the metallic keypad panel.

10. The metallic panel assembly having a ripple luster according to claim 1, wherein the electroplated layer penetrates into the first hollowed portion and the second hollowed portion.

11. The metallic panel assembly having a ripple luster according to claim 1, wherein the electroplated layer is made of a metallic material.

* * * * *